US006746372B2

(12) United States Patent
Hsu

(10) Patent No.: US 6,746,372 B2
(45) Date of Patent: Jun. 8, 2004

(54) EXERCISING BALL HOLDER

(76) Inventor: Cheng-Hsiung Hsu, No. 29-18, Kou-Chien Lane, Kou-Chien Li, Lu-Kang, Changhua Hsien (TW)

( * ) Notice: Subject to any disclaimer, the term of this patent is extended or adjusted under 35 U.S.C. 154(b) by 0 days.

(21) Appl. No.: 10/377,878

(22) Filed: Mar. 4, 2003

(65) Prior Publication Data

US 2003/0195098 A1 Oct. 16, 2003

(30) Foreign Application Priority Data

Apr. 12, 2002 (TW) ..... 91205010 U

(51) Int. Cl.[7] ..... A63B 4/00; A63B 7/08

(52) U.S. Cl. ..... 482/34; 482/126; 482/79; 482/147; 482/123

(58) Field of Search ..... 482/126–130, 482/140, 91, 79, 120–121, 77, 148, 907, 142, 132–4, 127; 601/23–28; 472/127, 134–135; 248/562, 599; 297/452.1, 452.41, 452.17; 473/423–430, 569; 273/118

(56) References Cited

U.S. PATENT DOCUMENTS 4,126,326 A * 11/1978 Phillips ..... 280/205
5,810,700 A * 9/1998 Orcutt ..... 482/123
5,833,587 A * 11/1998 Strong et al. ..... 482/123
6,461,284 B1 * 10/2002 Francavilla ..... 482/142

* cited by examiner

*Primary Examiner*—Nicholas D. Lucchesi
*Assistant Examiner*—L Amerson
(74) *Attorney, Agent, or Firm*—Rosenberg, Klein & Lee

(57) ABSTRACT

An exercising ball holder for fixing an exercising ball and locking elastic cords includes a base seat, multiple extension arms and at least one elastic cord. The base seat is formed with a rest depression. A lower end of the exercising ball is rested and located in the depression without easily rolling out. The multiple extension arms respectively outward horizontally extend from the base seat. Each extension arm has a fixing loop section. The elastic cord has a hook section and has a handle. It can ensure safety in use of the exercising ball. The position of the elastic cords can be quickly changed to achieve various exercising effects. And, it has simple structure.

4 Claims, 3 Drawing Sheets

EXERCISING BALL HOLDER

BACKGROUND OF THE INVENTION

The present invention is related to an exercising ball holder for fixing an exercising ball and locking elastic cords. It can ensure safety in use of the exercising ball. The position of the elastic cords can be quickly changed so as to achieve various exercising effects. Moreover, the exercising ball holder has simple structure and is manufactured at low cost.

FIGS. 1 and 2 show a conventional exercising ball 40 (usually called "Swiss ball" that is a big elastic plastic ball). The outer diameter of the exercising ball 40 is generally between 45 and 120 cm. A typical exercising ball 40 has an outer diameter between 50 and 80 cm. With respect to an exercising ball that has a 60-cm outer diameter, a user can sit thereon. Alternatively, the user can lie thereon. Even this user can face down, face up, or face laterally. However, the exercising ball 40 tends to roll away easily. So, the user is very likely to accidentally slip down or fall down and then gets hurt.

Furthermore, if the exercising ball 40 is used with an elastic cord (not shown), not only it is hard to fix the exercising ball 40 at a desire location, but also there is no place for locking the elastic cord. As a result, a user must carefully keep balanced and hold two ends of the elastic cord by both hands to exercise. It significantly limits the variety of the exercise patterns for the exercising ball 40 and the cooperative elastic cord.

SUMMARY OF THE INVENTION

It is therefore a primary object of the present invention to provide an exercising ball holder for preventing the exercising ball from randomly rolling. The exercising ball holder also is able to lock elastic cords so that the safety in use of the exercising ball can be ensured.

It is a further object of the present invention to provide the above exercising ball holder in which the position of the elastic cords can be quickly changed so as to achieve various exercising effects.

It is still a further object of the present invention to provide the above exercising ball holder that has simple structure and is manufactured at low cost.

The present invention can be best understood through the following description and accompanying drawings wherein:

DETAILED DESCRIPTION OF THE PREFERRED EMBODIMENTS

Figure 1:
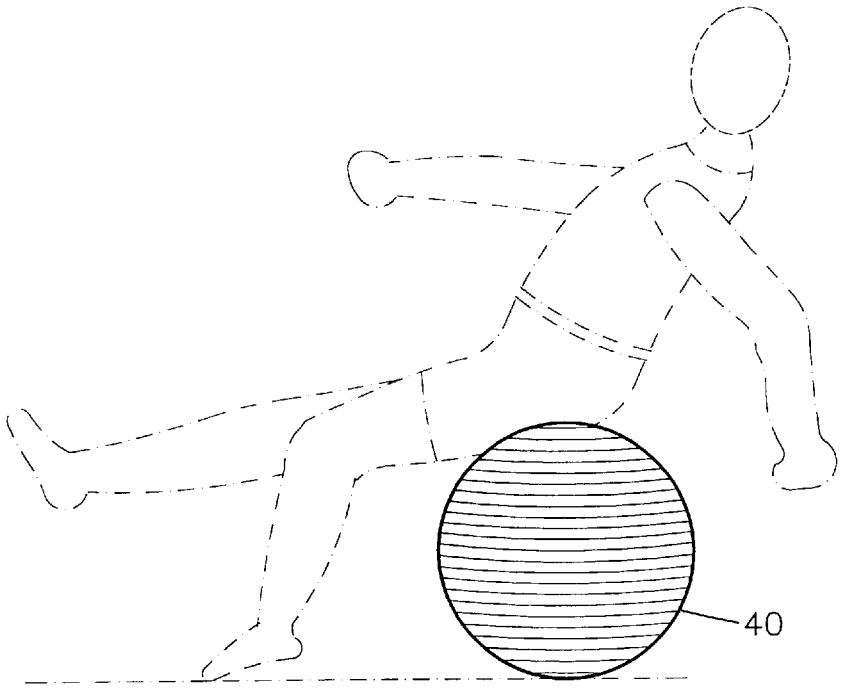
FIG. 1 (PRIOR ART)
FIG. 1 shows the use of a conventional exercising ball in one state.
Figure 2:
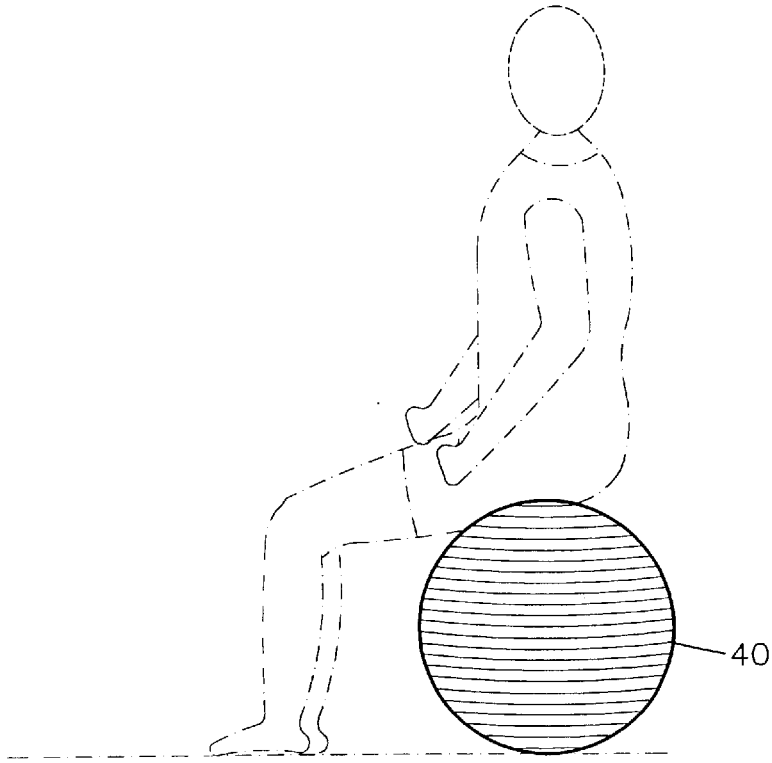
FIG. 2 (PRIOR ART)
FIG. 2 shows the use of the conventional exercising ball in another state.
Figure 3:
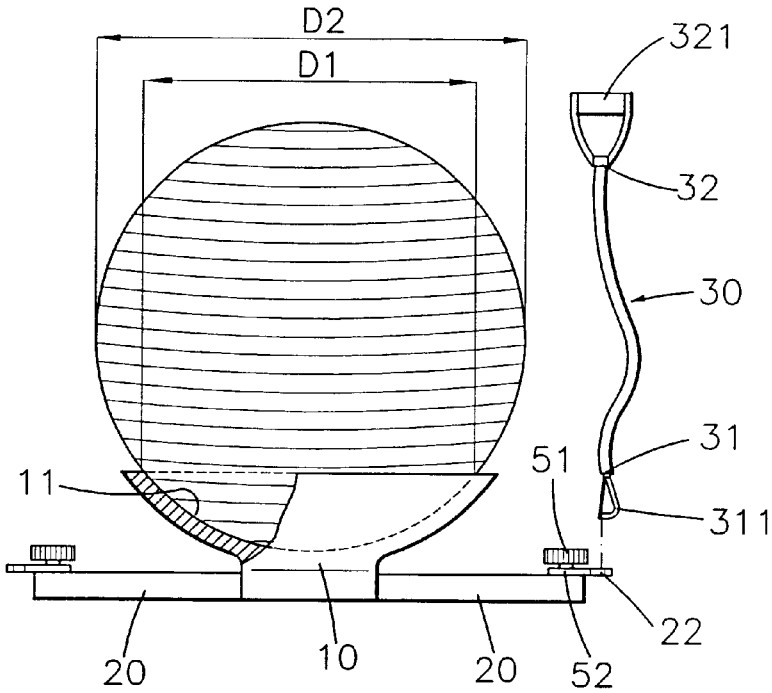
FIG. 3 is a partially sectional view of the present invention.
Figure 4:
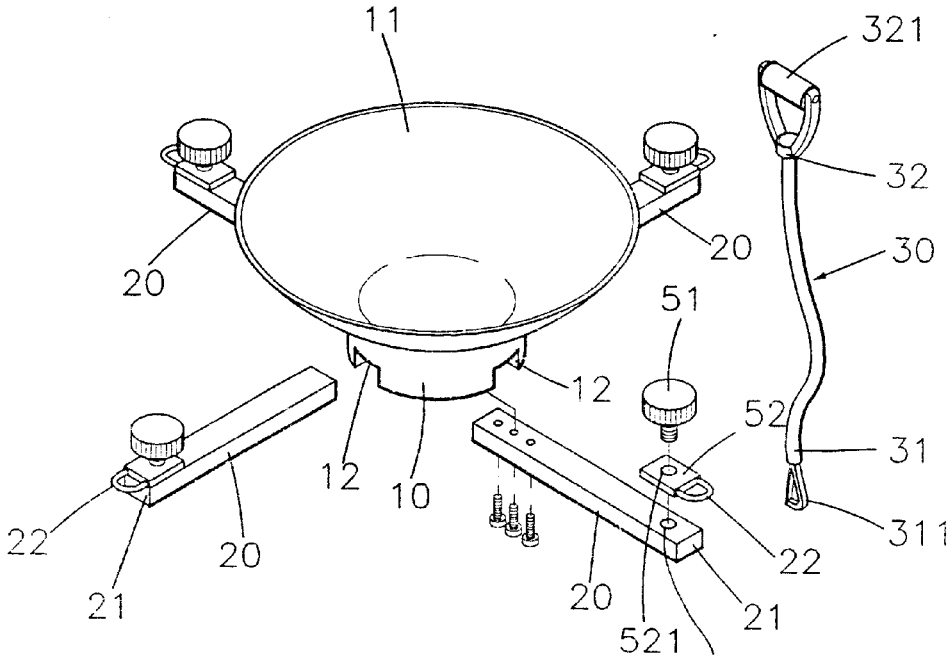
FIG. 4 is a perspective exploded view of the present invention.
Figure 5:
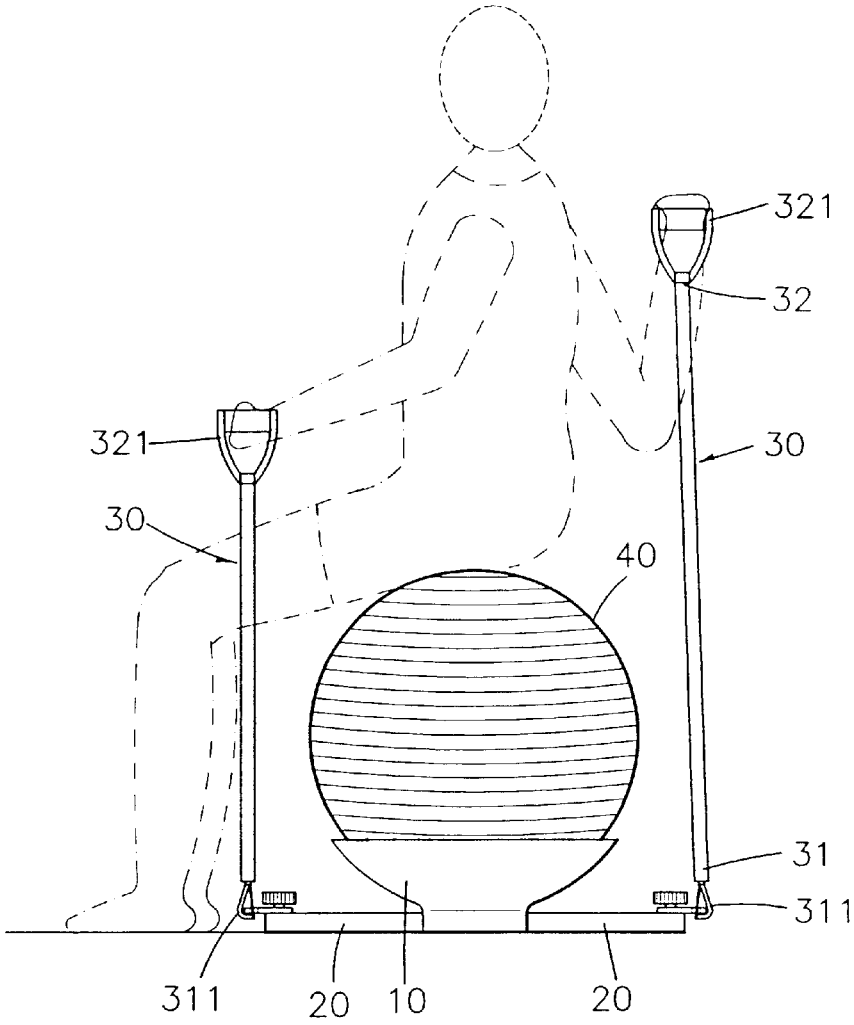
FIG. 5 shows the use of the present invention.

FIGS. 3 to 5 show the first embodiment of this invention. The exercising ball holder of the present invention mainly includes a base seat 10, multiple extension arms 20 and at least one elastic cord 30.

The base seat 10 is formed with a substantially concave rest depression 11 having an opening facing upward. A lower end of the exercising ball 40 is rested and located in the depression 11 without easily rolling out. The depression 11 is defined by a concave thin wall.

In order to prevent the exercising ball 40 from easily rolling out of the holder and to keep a user normally exercising with the exercising ball 40, the horizontal maximum inner diameter D1 of a top edge of the depression 11 is between 20 and 60 cm. For example, assuming that the horizontal maximum inner diameter D1 of the present invention is 40 cm and the diameter D2 of the exercising ball 40 is 60 cm; the lower end of the exercising ball 40 can be stably fixed without randomly rolling. If the exercising ball 40 is slightly smaller (for example, 50 cm) or slightly larger (for example, 70 cm), the exercising ball 40 still can be stably located.

The multiple extension arms 20 respectively outward horizontally extend from the base seat 10. (The extension arms 20 can be fixed with the base seat 10 by screws, locking elements, adhesive or integrally formed with the base seat 10.) The free end 21 of each extension arm 20 has a fixing loop section 22. In this embodiment, the free end 21 of each extension arm 20 is formed with a locking hole 211 for fixing a locking member 51. A fabric plate 52 formed with a central through hole 521 is disposed at the free end 21. The fixing loop section 22 is disposed on the fabric plate 52. The locking member 51 can insert into the locking hole 211 via the central through hole 521 so that the fabric plate 52 is connected to the corresponding extension arm 20.

Generally there are two elastic cords 30. Each elastic cord 30 has a first end 31 and a second end 32. The first end 31 is equipped with a hook section 311 (that can be easily released or locked) for fixedly connecting with the loop section 22. The second end 32 has a handle 321 for a user's hand to hold.

The bottom face of the base seat 10 is formed with multiple channels 12 for the extension arms 20 to insert therein. The extension arms 20 can be secured by screws. Alternatively, the extension arms 20 can be fixed with the base seat 10 by locking elements, tight fitting, adhesive or just integrally formed with the base seat 10.

In operation of the present invention, referring to FIG. 5, the four extension arms 20 are respectively positioned on front, rear, left and right sides of the user. Two elastic cords 30 are fixed on the front and rear (or left and right) extension arms 20. Then the user can sit on exercising ball to keep balanced and exercise his/her arms. Alternatively, these two elastic cords 30 can be fixed on the front and left or rear and right extension arms 20. Or, both the elastic cords 30 can be fixed on the front extension arms 20. Still alternatively, the user can change the sitting position into lying position. That is, the user can face down, up or laterally. Thus, various exercising patterns are achievable.

The exercising ball 40 is fixed without randomly rolling so that the safety in use of the exercising ball 40 is ensured and the user is prevented from slipping down or falling down.

Figure 6:
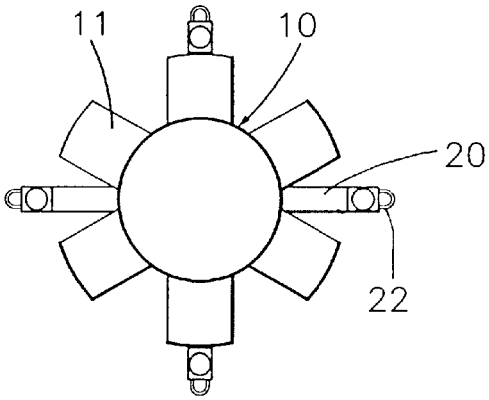
FIG. 6 is a top view of the second embodiment of the present invention.

FIG. 6 is a top view that shows the second embodiment of the present invention, in which the depression 11 is defined between multiple curved thin plates that are radially arranged as the walls of the depression 11. This also can fix the exercising ball 40 as the way in the first embodiment.

Figure 7:
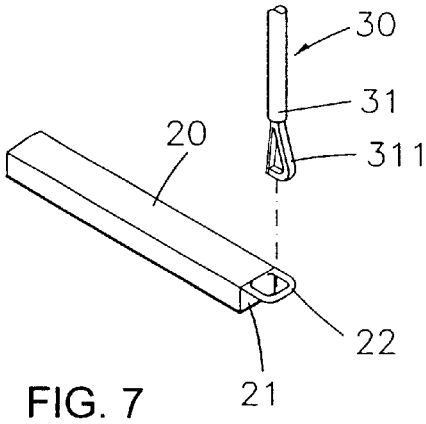
FIG. 7 is a perspective view of the third embodiment of the present invention.

FIG. 7 shows the third embodiment of the present invention. For each extension arm 20, the fixing loop section 22 is directly disposed on the free end 21 of the extension arm 20.

In conclusion, the present invention is able to fix the exercising ball and the elastic cords. It can be used to exercise the muscle of a user's arms under a save condition. Furthermore, the position of the elastic cords can be quickly changed so as to achieve various exercising effects. Moreover, the present invention has simple structure and is manufactured at low cost.

The above embodiments are only used to illustrate the present invention, not intended to limit the scope thereof. Many modifications of the above embodiments can be made without departing from the spirit of the present invention.

What is claimed is:

1. An exercising ball holder comprising:

a base seat formed with a substantially concave rest depression having an opening facing upward for receiving and locating a lower end of the exercising ball in the depression;

multiple extension arms respectively outward horizontally extending from the base seat, a free end of each extension arm having a fixing loop section; and at least one elastic cord having a first end and a second end, the first end being equipped with a hook section for connecting with the loop section, the second end having a handle for holding, wherein a horizontal maximum inner diameter of a top edge of the depression is between 20 and 60 cm.

2. The exercising ball holder as claimed in claim 1, wherein the depression is defined by a concave thin wall.

3. The exercising ball holder as claimed in claim 1, wherein the depression is defined by multiple curved thin plates that are radially arranged.

4. The exercising ball holder as claimed in claim 1, wherein the free end of each extension arm is formed with a locking hole for engaging with a locking member, a fabric plate formed with a central through hole being disposed at the free end, the fixing loop section being disposed on the fabric plate.

* * * * *